US012116236B2

(12) United States Patent
Harada et al.

(10) Patent No.: US 12,116,236 B2
(45) Date of Patent: Oct. 15, 2024

(54) FEEDING DEVICE, IMAGE FORMING APPARATUS, AND FEEDING METHOD

(71) Applicant: FUJIFILM Business Innovation Corp., Tokyo (JP)

(72) Inventors: Shinya Harada, Kanagawa (JP); Shinichi Kawai, Kanagawa (JP); Tomoyasu Tanaka, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 343 days.

(21) Appl. No.: 17/535,665

(22) Filed: Nov. 25, 2021

(65) Prior Publication Data

US 2022/0380156 A1 Dec. 1, 2022

(30) Foreign Application Priority Data

May 31, 2021 (JP) ..... 2021-091356

(51) Int. Cl.
*B65H 1/14* (2006.01)
*B65H 7/20* (2006.01)
*B65H 5/06* (2006.01)

(52) U.S. Cl.
CPC ..... *B65H 7/20* (2013.01); *B65H 1/14* (2013.01); *B65H 5/068* (2013.01); *B65H 2301/4434* (2013.01); *B65H 2601/322* (2013.01)

(58) Field of Classification Search
CPC ... B65H 7/02; B65H 7/04; B65H 7/20; B65H 5/068; B65H 1/04; B65H 1/14; B65H 2513/10; B65H 2801/06; B65H 2511/414; B65H 2301/4434; B65H 2601/332; B65H 2405/15; B65H 2405/353
See application file for complete search history.

(56) References Cited

U.S. PATENT DOCUMENTS

| | | | | |
|---|---|---|---|---|
| 9,254,973 | B2 * | 2/2016 | Ishida | B65H 7/02 |
| 9,499,365 | B2 * | 11/2016 | Yamaoka | B65H 7/02 |
| 10,364,119 | B2 * | 7/2019 | Uchibori | B65H 7/20 |

FOREIGN PATENT DOCUMENTS

| | | | | |
|---|---|---|---|---|
| JP | 2009113917 | | 5/2009 | |
| JP | 2009113918 | | 5/2009 | |
| JP | 2009203009 | | 9/2009 | |
| JP | 7363365 | B2 * | 10/2023 | B65H 1/14 |

* cited by examiner

*Primary Examiner* — Leslie A Nicholson, III
(74) *Attorney, Agent, or Firm* — JCIPRNET

(57) ABSTRACT

A feeding device includes an accommodation unit that accommodates paper, a feeding tray on which the paper is placed in the accommodation unit and that is controlled so as to be lifted and lowered in a case of being replenished with the paper, and a processor configured to determine a lifting and lowering speed of the feeding tray according to an operation by a user, and perform control such that a lifting and lowering speed of the feeding tray becomes slower than the determined lifting and lowering speed in a case of a state where the determined lifting and lowering speed of the feeding tray is unable to be realized.

15 Claims, 10 Drawing Sheets

| LIFTING AND LOWERING BUTTON PRESSING | LIFTING AND LOWERING SPEED (cm/sec) |
|---|---|
| - | 0.5 |
| ONCE | 1.0 |
| TWICE | 2.0 |
| PRESSING AND HOLDING | 3.0 |

| LIFTING AND LOWERING BUTTON PRESSING | LIFTING AND LOWERING SPEED (cm/sec) |
|---|---|
| – | 0.5 |
| ONCE | 1.0 |
| TWICE | 2.0 |
| PRESSING AND HOLDING | 3.0 |

FEEDING DEVICE, IMAGE FORMING APPARATUS, AND FEEDING METHOD

CROSS-REFERENCE TO RELATED APPLICATIONS

This application is based on and claims priority under 35 USC 119 from Japanese Patent Application No. 2021-091356 filed May 31, 2021.

BACKGROUND

(i) Technical Field

The present invention relates to a feeding device, an image forming apparatus, and a feeding method.

(ii) Related Art

JP2009-113917A and JP2009-113918A disclose a paper loading device 30 including a biasing mechanism 50 that is provided on a housing 31 side surface at a height lowered by a predetermined distance from a relifted position U of a tray 32 and biases the tray 32 upward, in which the biasing mechanism 50 allows the tray 32 to lower beyond a place of the biasing mechanism 50 only in a case where a weight exceeding a predetermined weight is biased against the tray 32.

JP2009-203009A discloses the paper loading device 30 including the tray 32 that is disposed to be capable of being lifted and lowered in the housing 31 and on which paper P is placed on an upper surface thereof, a lifting and lowering mechanism 40 that lifts the tray 32 by obtaining power from a motor 14 and lowers the tray by the action of gravity, and a stopping device 50 that performs locking by engaging with the lifting and lowering mechanism 40 and is capable of stopping the lowering of the tray 32.

SUMMARY

There is a feeding device that performs feeding to a predetermined position at a uniform lifting and lowering speed by lifting and lowering a feeding tray, on which paper is placed, in a case of replenishing an image forming apparatus with paper. However, in a case of lifting and lowering the feeding tray at the uniform lifting and lowering speed, a time for lifting and lowering the feeding tray becomes longer than necessary, and a time for replenishing in a case of paper replenishment becomes longer.

In addition, there is the feeding device that has a function of changing the lifting and lowering speed of the feeding tray according to the operation of a user. However, in a case where the lifting and lowering speed of the feeding tray becomes faster in a state where the weight of the feeding tray is heavy, a load is applied to a driving mechanism that lifts and lowers the feeding tray, and the driving mechanism breaks down in some cases.

Aspects of non-limiting embodiments of the present disclosure relate to a feeding device, an image forming apparatus, and a feeding method that have a function, in which the lifting and lowering speed of the feeding tray is changed by the user, and can prevent a breakdown of the driving mechanism.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided a feeding device including an accommodation unit that accommodates paper, a feeding tray on which the paper is placed in the accommodation unit and that is controlled so as to be lifted and lowered in a case of being replenished with the paper, and a processor configured to determine a lifting and lowering speed of the feeding tray according to an operation by a user, and perform control such that a lifting and lowering speed of the feeding tray becomes slower than the determined lifting and lowering speed in a case of a state where the determined lifting and lowering speed of the feeding tray is unable to be realized.

BRIEF DESCRIPTION OF THE DRAWINGS

Exemplary embodiment(s) of the present invention will be described in detail based on the following figures, wherein.

DETAILED DESCRIPTION

Next, an exemplary embodiment of the present invention will be described in detail with reference to the drawings.

Figure 1:
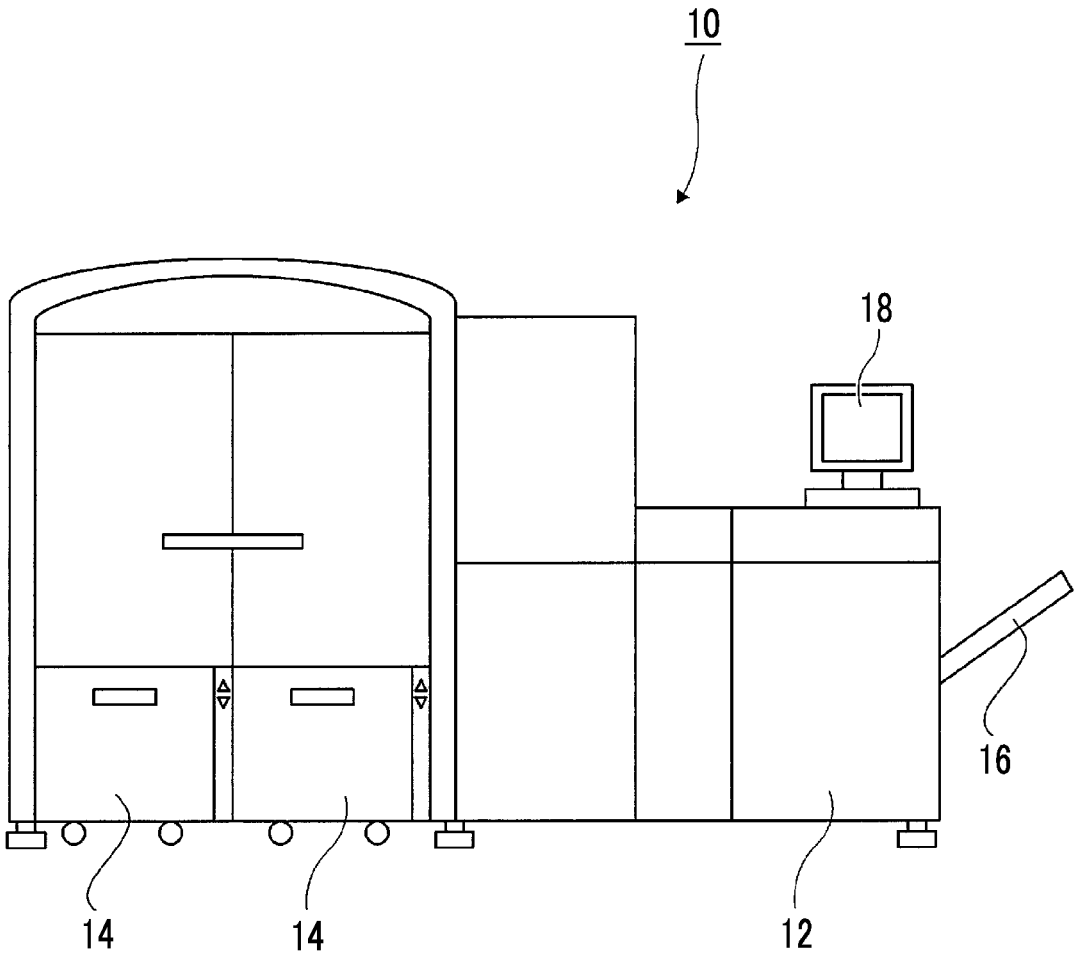
FIG. 1 is a side view showing an image forming apparatus according to an exemplary embodiment of the present invention.
Figure 2:
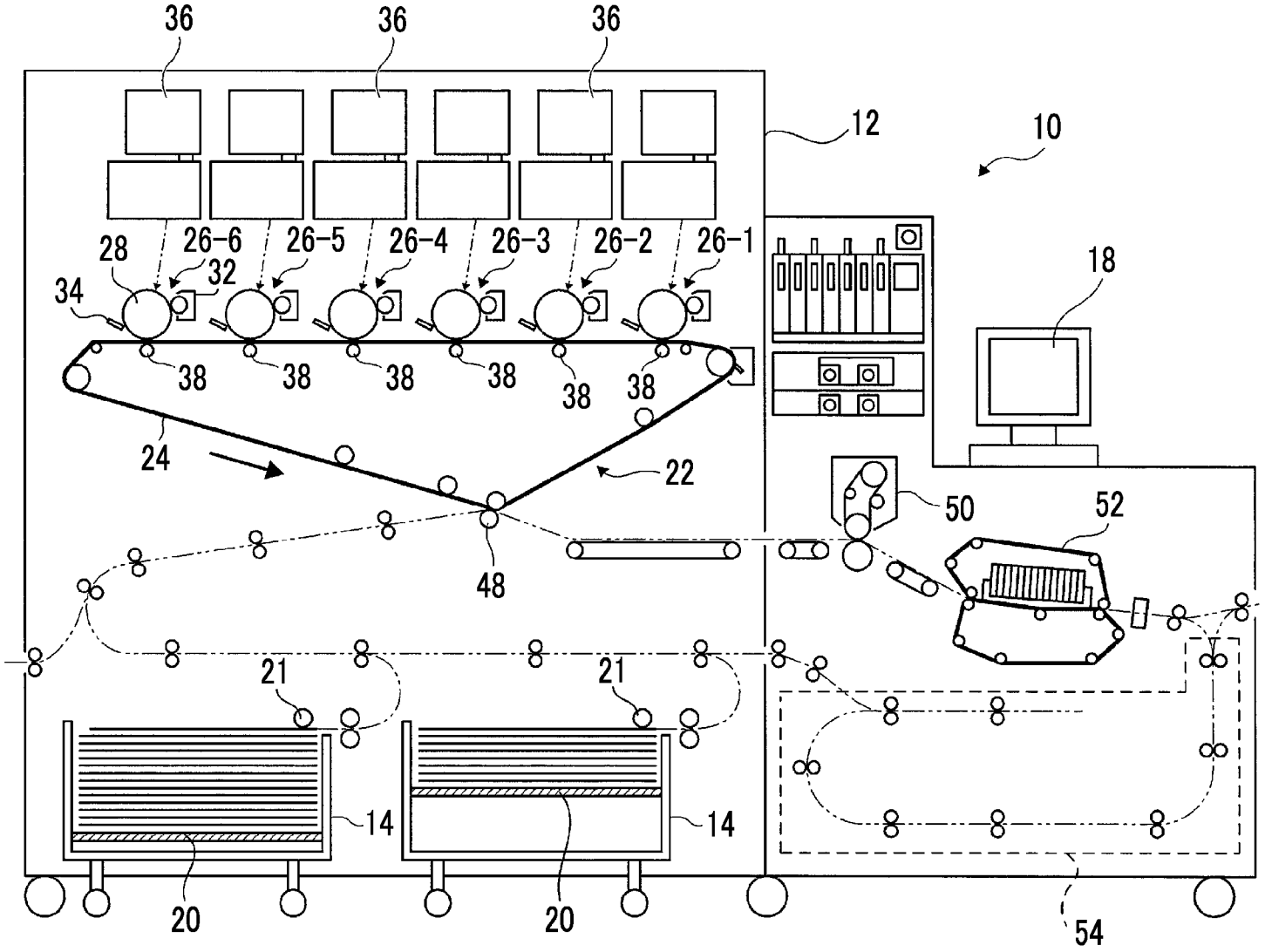
FIG. 2 is a side view of a partial cross section showing the image forming apparatus according to the exemplary embodiment of the present invention.

FIG. 1 shows an image forming apparatus 10 according to the exemplary embodiment of the present invention.

In FIG. 1, the image forming apparatus 10 is configured by an image forming apparatus body 12, a feeding device 14, a discharging unit 16, and a display operation unit 18. The image forming apparatus body 12 forms an image on paper, such as a recording medium. The discharging unit 16 discharges the paper, on which the image is formed by the image forming apparatus body 12, and stacks the paper. The display operation unit 18 includes a display screen and performs setting of the image forming apparatus 10.

The image forming apparatus body 12 includes a feeding roller 21 disposed above the feeding device 14 in a state where the feeding device 14 is mounted on the image forming apparatus body 12. In addition, an image forming portion 22 that forms an image on paper supplied from the feeding device 14 is provided above the feeding device 14. The image forming apparatus 10 has, for example, two feeding devices 14. Each feeding device 14 is configured to be capable of accommodating a large amount of paper and accommodating paper of different types and sizes. Paper placed on an uppermost portion of a feeding tray 20 of each of the feeding devices 14 is supplied one by one to the image forming portion 22 by the feeding roller 21.

The image forming portion 22 includes an intermediate transfer belt 24. For example, six image forming units 26 are provided above the intermediate transfer belt 24. The image forming unit 26 forms an image using a toner selected from special color developers, such as gold, silver, transparent, white, and orange, in addition to basic color developers, such as yellow (Y), magenta (M), cyan (C), and black (K).

The image forming unit 26 is, for example, a xerographic type, and is configured by a photoconductor drum 28, a charging device that is charging means uniformly charging the surface of the photoconductor drum 28, a developing device 32 that develops an electrostatic latent image formed on the photoconductor drum 28, and a cleaning device 34. The photoconductor drum 28 is a cylindrical image holder that holds a toner image (developer image), and is uniformly charged by the charging device. An electrostatic latent image is formed thereon with laser light emitted by an optical scanning device 36. The electrostatic latent image formed on the photoconductor drum 28 is developed with a toner by the developing device 32. A primary transfer roller 38 is provided at a position facing the photoconductor drum 28 with the intermediate transfer belt 24 sandwiched therebetween. The toner image developed by the developing device 32 is transferred to the intermediate transfer belt 24 by the primary transfer roller 38. Residual toners, paper dust, and the like adhered to the photoconductor drum 28 after a toner image transfer step are removed by the cleaning device 34.

The toner image transferred to the intermediate transfer belt 24 by the image forming unit 26 is secondarily transferred to paper fed from the feeding device 14 by a secondary transfer roller 48. The paper to which the image is transferred is sent to a fixing unit 50, and the image is fixed with, for example, heat and pressure. The paper on which the image is fixed in this manner is further cooled by a cooling unit 52. In addition, a reversing unit 54 is provided on a wake side of the cooling unit 52, the paper is reversed by the reversing unit 54 and returns to a secondary transfer roller 48 side, and an image can be formed on both sides of the paper.

Figure 3:
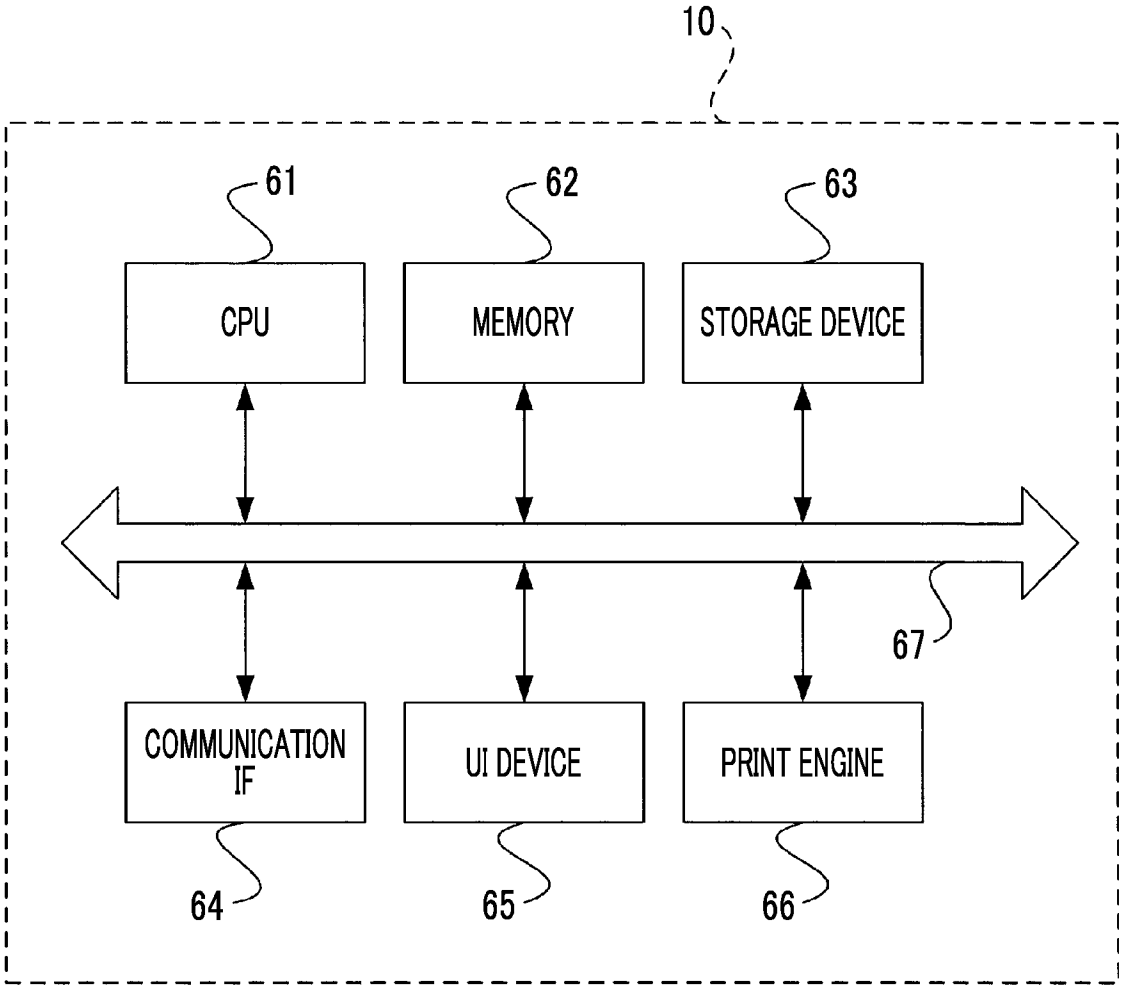
FIG. 3 is a block diagram showing a hardware configuration of a control device used in the image forming apparatus according to the exemplary embodiment of the present invention.

Next, a hardware configuration of the image forming apparatus 10 of the present exemplary embodiment will be shown in FIG. 3.

As shown in FIG. 3, the image forming apparatus 10 has a CPU 61, a memory 62, a storage device 63 such as a hard disk drive, a communication interface (abbreviated as IF) 64 that transmits and receives data to and from an external device and the like via a network, a user interface (abbreviated as UI) device 65 that includes a touch panel, a liquid crystal display, and a keyboard, and a print engine 66. These components are connected to each other via a control bus 67.

The print engine 66 prints an image on paper via steps such as charging, exposing, developing, transferring, and fixing.

The CPU 61 is a processor that executes predetermined processing based on a control program stored in the memory 62 or the storage device 63, and controls an operation of the image forming apparatus 10. Although it is described that the CPU 61 reads and executes the control program stored in the memory 62 or the storage device 63 in the present exemplary embodiment, it is also possible to provide the CPU 61 with the program by storing the program in a storage medium such as a CD-ROM.

Figure 4:
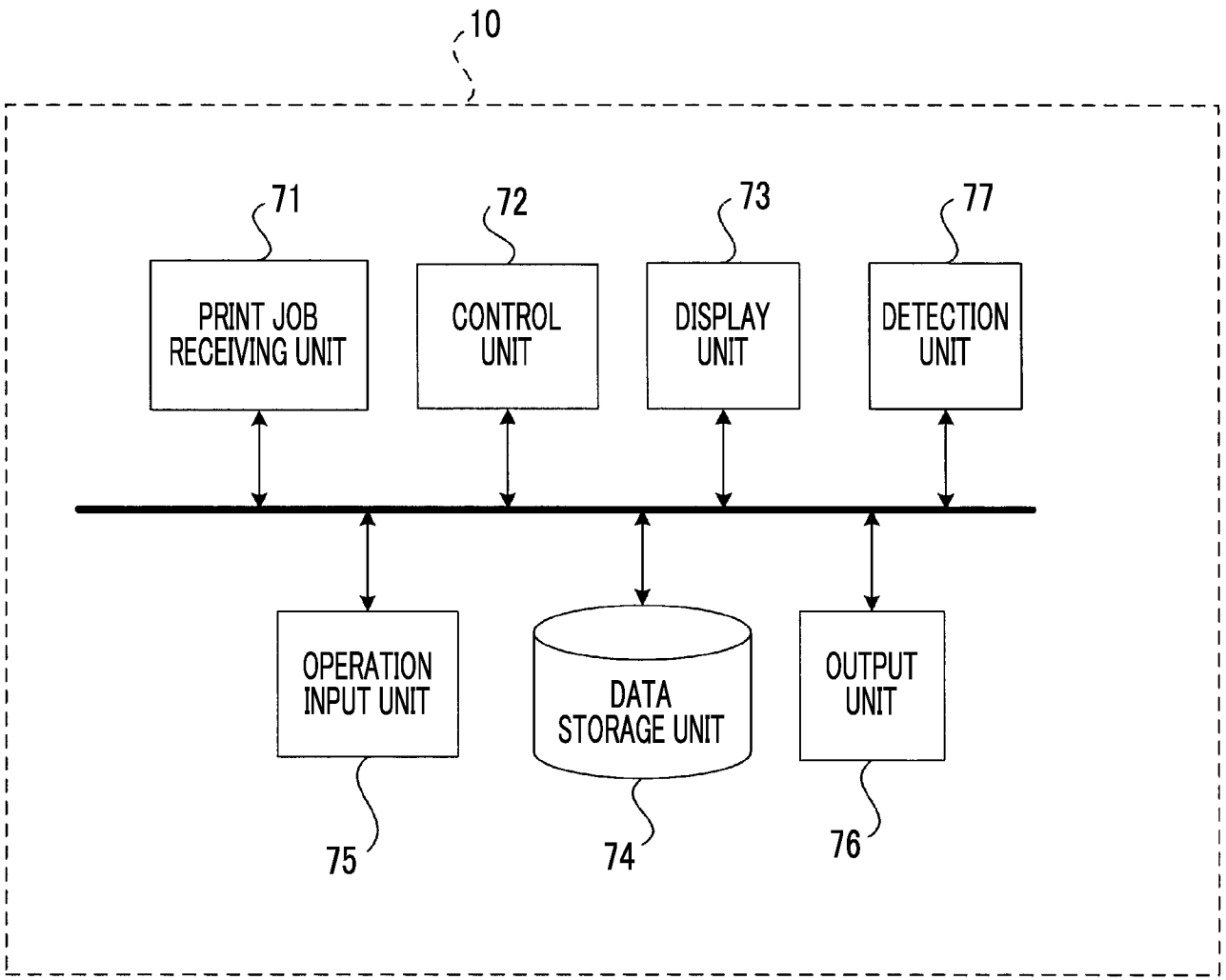
FIG. 4 is a block diagram showing a functional configuration of the image forming apparatus according to the exemplary embodiment of the present invention.

FIG. 4 is a block diagram showing a functional configuration of the image forming apparatus 10, which is realized by executing the control program.

As shown in FIG. 4, the image forming apparatus 10 of the present exemplary embodiment includes a print job receiving unit 71, a control unit 72, a display unit 73, a data storage unit 74, an operation input unit 75, an output unit 76, and a detection unit 77.

The print job receiving unit 71 receives a print job (an example of a print instruction) transmitted from a terminal device.

The control unit 72 generates image data, which is print data, based on the print job received by the print job receiving unit 71 and performs control such that the generated image data is output from the output unit 76.

The data storage unit 74 stores various types of data such as the image data generated by the control unit 72.

Figures 5, 6:
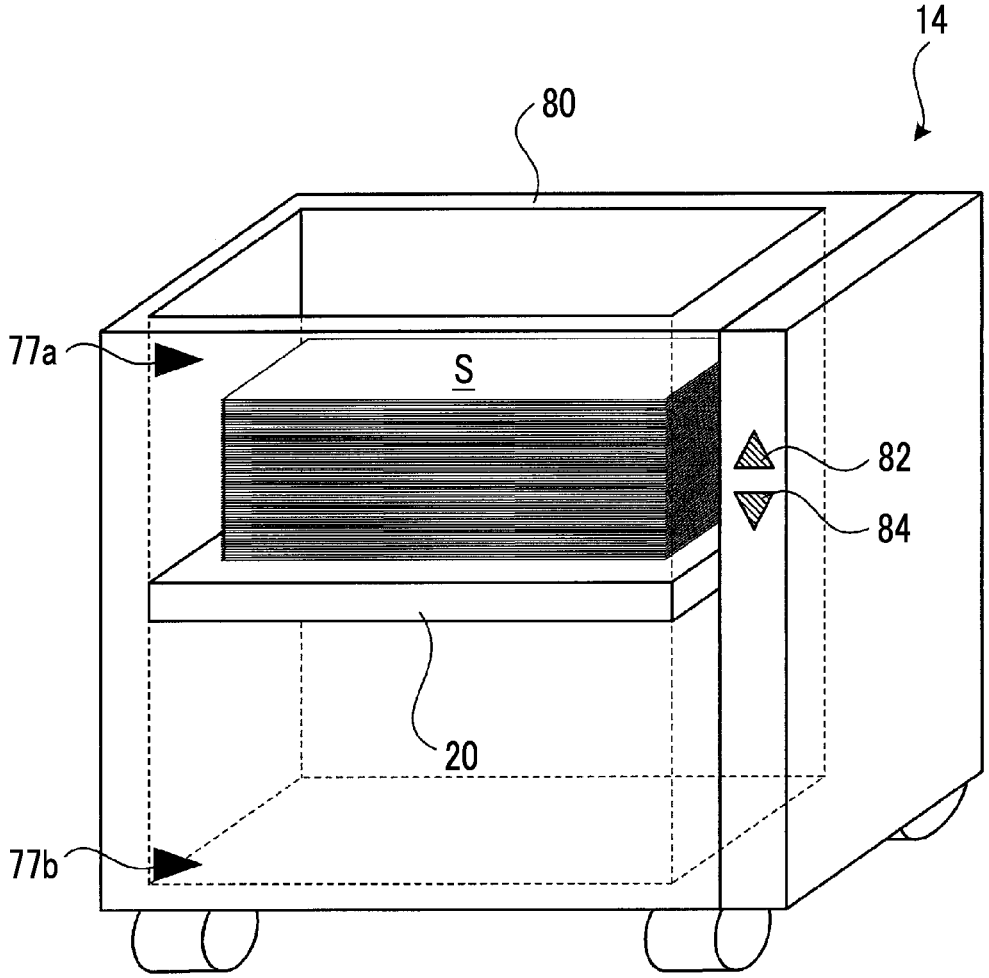
FIG. 5 is a table showing an example of data stored in a data storage unit of the image forming apparatus according to the exemplary embodiment of the present invention.
FIG. 6 is a partially perspective view showing a feeding device of the image forming apparatus according to the exemplary embodiment of the present invention.

In addition, as shown in FIG. 5, the data storage unit stores data by associating the number of times of pressing or a pressing time of a lifting and lowering button, which determines the lifting and lowering of the feeding tray 20, with the lifting and lowering speed of the feeding tray 20. That is, it is possible for the control unit 72 to change the lifting and lowering speed of the feeding tray 20 according to the number of times of pressing or the pressing time of the lifting and lowering button. In addition, it is possible for the control unit 72 to calculate the current position of the feeding tray 20, which will be described later in detail, according to the number of times of pressing or the pressing time of the lifting and lowering button.

The output unit 76 functions as an image output unit that outputs an image on paper based on control by the control unit 72.

The display unit 73 is controlled by the control unit 72 and displays various types of information on the display screen of the display operation unit 18, the terminal device, or the like. The operation input unit 75 inputs various types of information on operations performed by a user.

The detection unit 77 functions as detector that is provided at each of an upper end and a lower end in an accommodation unit of the feeding device 14, which accommodates paper, and detects the position of the feeding tray 20 by detecting paper or the feeding tray 20 in the accommodation unit.

In addition, the control unit 72 performs control such that the feeding tray 20 is lifted and lowered in response to the pressing of the lifting and lowering button in a case where the feeding device 14 is replenished with paper. Further, the control unit 72 performs control such that the lifting and lowering speed of the feeding tray 20 changes according to the number of times of pressing or the pressing time of the lifting and lowering button. That is, the control unit 72 determines the lifting and lowering speed of the feeding tray 20 according to the operation of the user.

Specifically, in a case where the user presses the lifting and lowering button once, the control unit 72 performs control such that the feeding tray 20 is lifted and lowered at a low lifting and lowering speed, for example, 1.0 cm/sec. In addition, in a case where the user presses the lifting and lowering button twice, the control unit 72 performs control such that the feeding tray 20 is lifted and lowered at a medium lifting and lowering speed, for example, 2.0 cm/sec. In addition, in a case where the user presses the lifting and lowering button and holds for a predetermined time, for example, several seconds, the control unit 72 performs control such that the feeding tray 20 is lifted and lowered at a high lifting and lowering speed, for example, 3.0 cm/sec.

In addition, in a case where the feeding tray 20 moves from the current position at the determined lifting and lowering speed, the control unit 72 calculates a lifting and lowering maximum time that is a maximum time until the feeding tray 20 reaches a feeding position, which is a position set in advance.

In addition, in a case where the detection unit 77 does not detect that the feeding tray 20 has reached the feeding position within the calculated lifting and lowering maximum time, the control unit 72 performs control such that the lifting and lowering speed of the feeding tray 20 becomes slower than the determined lifting and lowering speed.

In addition, in a case where the detection unit 77 does not detect that the feeding tray 20 has reached the feeding position within the calculated lifting and lowering maximum time, the control unit 72 performs control such that the lifting and lowering speed of the feeding tray 20 becomes gradually slower.

In addition, the control unit 72 performs control such that the lifting and lowering maximum time is recalculated in a case where the lifting and lowering speed of the feeding tray 20 has been changed during the lifting and lowering of the feeding tray 20.

That is, in a case where the lifting and lowering speed of the feeding tray 20 has been changed during the lifting and lowering of the feeding tray 20, the control unit 72 calculates the current position of the feeding tray 20 from the lifting and lowering speed before the change and an operating time until the present and recalculates a lifting and lowering maximum time using the lifting and lowering speed after the change.

In addition, in a case of a state where the lifting and lowering speed of the feeding tray 20, which is determined by the operation of the user, cannot be realized, the control unit 72 performs control such that the lifting and lowering speed of the feeding tray 20 becomes slower than the determined lifting and lowering speed. Herein, the state where the determined lifting and lowering speed of the feeding tray 20 cannot be realized includes a case where the determined lifting and lowering speed cannot be realized and the detection unit 77 does not detect that the feeding tray 20 has reached the feeding position within the calculated lifting and lowering maximum time, for example, since the weight of paper loaded on the feeding tray 20 is high and an excessive load is applied to a drive engine.

In addition, in a case of a state where the lifting and lowering speed of the feeding tray 20, which is determined by the operation of the user, cannot be realized, the control unit 72 performs control such that the lifting and lowering speed of the feeding tray 20 becomes gradually slower than the determined lifting and lowering speed.

In addition, in a case where the detection unit 77 does not detect the position of the feeding tray 20 within the calculated lifting and lowering maximum time, the control unit 72 performs control such that the lifting and lowering speed of the feeding tray 20 is changed to an ultra-low lifting and lowering speed by high torque with which a drive force larger than a drive force at a normal lifting and lowering speed is obtained.

Specifically, for example, in a case where the lifting and lowering speed of the feeding tray 20, which is determined as the user presses the lifting and lowering button, is a high speed, and in a case where the position of the feeding tray 20 is not detected within the lifting and lowering maximum time realized when the feeding tray is lifted and lowered at the high speed, the control unit 72 performs control such that the lifting and lowering speed is changed to a medium speed slower than the high speed, assuming that it is a state where the lifting and lowering at the high speed cannot be realized. In addition, in a case where the lifting and lowering speed of the feeding tray 20, which is determined as the user presses the lifting and lowering button, is a medium speed and a case where the position of the feeding tray 20 is not detected within the lifting and lowering maximum time realized when the feeding tray is lifted and lowered at the medium speed, the control unit 72 performs control such that the lifting and lowering speed is changed to a low speed slower than the medium speed, assuming that it is a state where the lifting and lowering at the medium speed cannot be realized. In addition, in a case where the lifting and lowering speed of the feeding tray 20, which is determined as the user presses the lifting and lowering button, is a low speed and in a case where the position of the feeding tray 20 is not detected within the lifting and lowering maximum time realized when the feeding tray is lifted and lowered at the low speed, the control unit 72 performs control such that the lifting and lowering speed is changed to an ultra-low speed slower than the low speed, for example, 0.5 cm/sec, assuming that it is a state where the lifting and lowering at the low speed cannot be realized.

Then, in a case where the lifting and lowering speed is changed to the ultra-low speed by high torque, the control unit 72 recalculates a lifting and lowering maximum time using the lifting and lowering speed after the change. Then, in a case where the detection unit 77 does not detect the position of the feeding tray 20 within the recalculated lifting and lowering maximum time, the control unit 72 performs control such that the display operation unit 18, the terminal device, or the like is notified of an abnormality of a driving mechanism of the feeding tray 20, and lifting and lowering is stopped.

FIG. 6 is a partially perspective view of the feeding device 14.

The feeding device 14 includes an accommodation unit 80 that accommodates paper S and the feeding tray 20 that is for placing the paper S in the accommodation unit 80. The feeding tray 20 is substantially horizontally held by the driving mechanism (not shown) in the accommodation unit 80. A configuration where the periphery of the feeding tray is covered with the accommodation unit 80 and the position of the feeding tray 20 cannot be visually recognized from a front side is adopted.

On a front surface of the feeding device 14, a lifting button 82 and a lowering button 84, which are examples of the lifting and lowering button determining the lifting and lowering of the feeding tray 20, are provided. The lifting button 82 causes the feeding tray 20 to be substantially horizontally lifted in response to an operation by the user. The lowering button 84 causes the feeding tray 20 to be substantially horizontally lowered in response to an operation by the user. That is, the feeding tray 20 is configured to be capable of being substantially horizontally lifted and lowered by the pressing of the lifting button 82 or the lowering button 84. In addition, the feeding tray 20 is configured to be lifted and lowered by changing the lifting and lowering speed according to the number of times of pressing or the pressing time of the lifting button 82 or the lowering button. In addition, the feeding tray 20 is configured such that the lifting and lowering speed thereof is changed by pressing the lifting button 82 or the lowering button 84 during the lifting and lowering of the feeding tray 20.

A detection unit 77*a* that detects the position of the feeding tray 20 by detecting the paper S or the feeding tray 20 is provided at an upper end of the accommodation unit 80. A detection unit 77*b* that detects the position of the feeding tray 20 by detecting the feeding tray 20 is provided at a lower end of the accommodation unit 80.

That is, in a case where the detection unit 77*a* has detected the paper S or the feeding tray 20, the control unit 72 stops the feeding tray 20 assuming that the feeding tray 20 is at an upper end position in the accommodation unit 80 and is at the feeding position where the paper S placed on the uppermost portion of the feeding tray 20 is fed by the feeding roller 21 one by one.

In addition, in a case where the detection unit 77*b* has detected the feeding tray 20, the control unit 72 stops the feeding tray 20 assuming that the feeding tray 20 is at a lower end position in the accommodation unit 80 and is at a replenishing position where the paper S is replenished.

Next, the lifting and lowering operation of the feeding tray 20 in the feeding device 14 will be described with reference to FIGS. 7A to 13C.

Figure 7A:
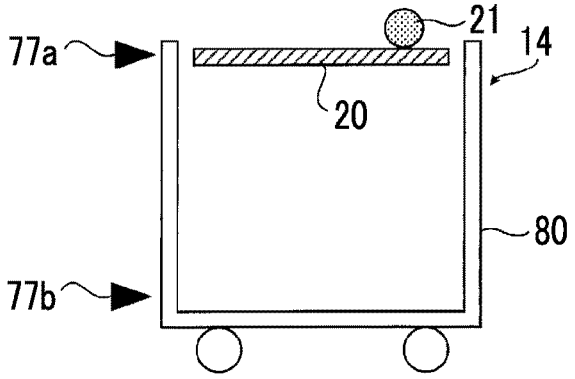
FIGS. 7A to 7D are views for describing a lifting and lowering operation of a feeding tray in the feeding device according to the exemplary embodiment of the present invention.
Figure 7B:
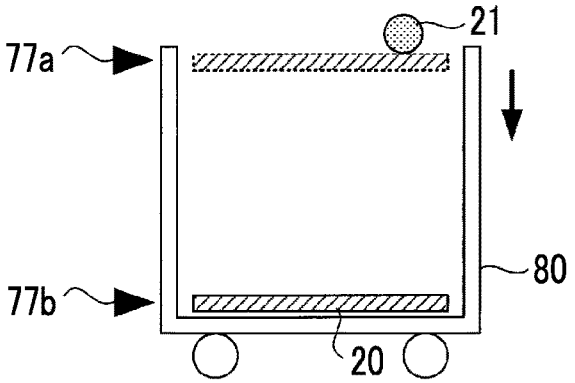

First, in a case where there is no paper S, which is to be fed to the image forming portion 22 by the feeding roller 21, on the feeding tray 20 and paper shortage is detected as shown in FIG. 7A, the control unit 72 lowers the feeding tray 20 and stops the lowering in response to the detection of the feeding tray 20 by the detection unit 77*b* as shown in FIG. 7B. That is, the control unit 72 stops the feeding tray 20 at the replenishing position which is at the lower end in the accommodation unit 80. In addition, the user can manually lift and lower the feeding tray 20 using the lifting button 82 or the lowering button 84 and can adjust a stop position of the feeding tray 20.

Figure 7C:
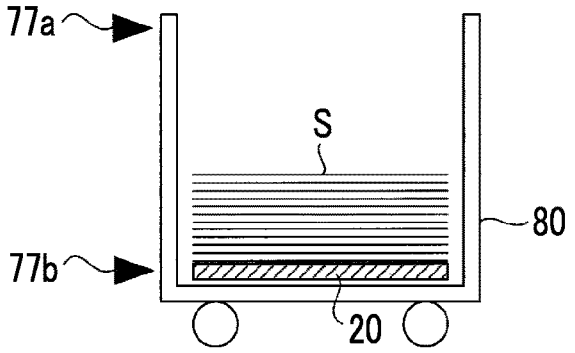

Then, as shown in FIG. 7C, the user pulls out the feeding device 14 from the image forming apparatus body 12, sets the paper S, and pushes the feeding device 14 into the image forming apparatus body 12.

Then, in a case where the lifting button 82 is pressed in Step S101, the lifting and lowering speed of the feeding tray 20 is determined, and the control unit 72 calculates a lifting and lowering maximum time for the feeding tray 20 in Step S102.

That is, according to the number of times of pressing or the pressing time of the lifting button 82 caused by an operation by the user, the lifting and lowering speed of the feeding tray 20 is determined and the lifting and lowering maximum time for the feeding tray 20 is calculated.

Figure 9:
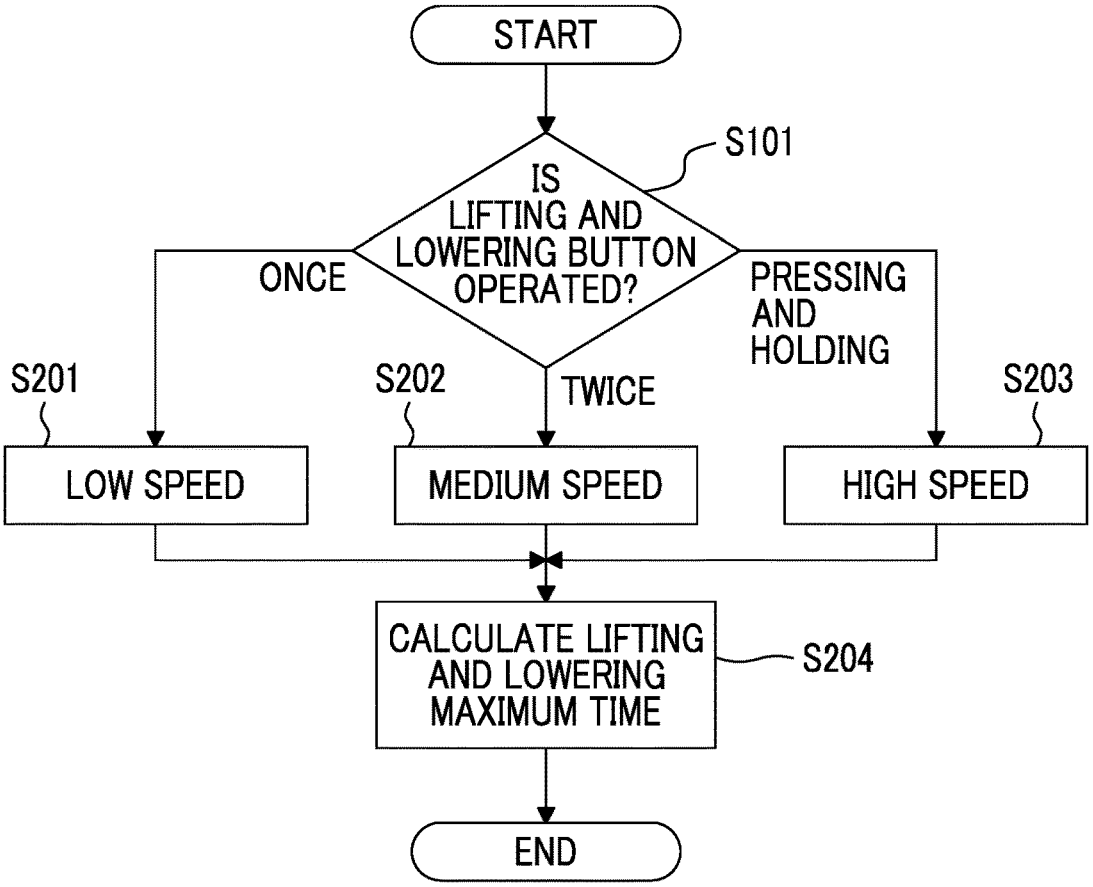
FIG. 9 is a flowchart for describing determination on a lifting and lowering speed of the feeding device and a lifting and lowering maximum time calculating operation according to the exemplary embodiment of the present invention.

FIG. 9 is a flowchart for describing details of Step S102. In the following, a case where a height in the accommodation unit 80, the height being a length from the lower end to the upper end in the accommodation unit 80 and being a length from the replenishing position to the feeding position for paper, is set to 60 cm will be described as an example.

For example, in a case where the lifting button 82 is pressed once in Step S101, the control unit 72 performs control such that the feeding tray 20 is lifted at, for example, 1.0 cm/sec, which is a low speed operation stored in the data storage unit 74, in Step S201. Then, in Step S204, the control unit 72 calculates a lifting and lowering maximum time from the current replenishing position to the feeding position using the lifting and lowering speed of Step S201. That is, 60 seconds that is obtained by dividing 60 cm, which is the length from the current replenishing position to the feeding position, by the lifting and lowering speed of 1.0 cm/sec is calculated as the lifting and lowering maximum time.

In addition, in a case where the lifting button 82 is pressed twice in Step S101, the control unit 72 performs control such that the feeding tray is lifted at, for example, 2.0 cm/sec, which is a medium speed operation stored in the data storage unit 74, in Step S202. Then, in Step S204, the control unit 72 calculates a lifting and lowering maximum time from the current replenishing position to the feeding position using the lifting and lowering speed of Step S202. That is, 30 seconds that is obtained by dividing 60 cm, which is the length from the current replenishing position to the feeding position, by the lifting and lowering speed of 2.0 cm/sec is calculated as the lifting and lowering maximum time.

In addition, in a case where the lifting button 82 is pressed and held, for example, a case where the lifting button is pressed for 3 seconds in Step S101, the control unit 72 performs control such that the feeding tray is lifted at, for example, 3.0 cm/sec, which is a high speed operation stored in the data storage unit 74, in Step S203. Then, in Step S204, the control unit 72 calculates a lifting and lowering maximum time from the current replenishing position to the feeding position using the lifting and lowering speed of Step S203. That is, 20 seconds that is obtained by dividing 60 cm, which is the length from the current replenishing position to the feeding position, by the lifting and lowering speed of 3.0 cm/sec is calculated as the lifting and lowering maximum time.

Then, in Step S103, the control unit 72 starts lifting and lowering at the lifting and lowering speed determined in Step S102, and starts a timer.

Figure 7D:
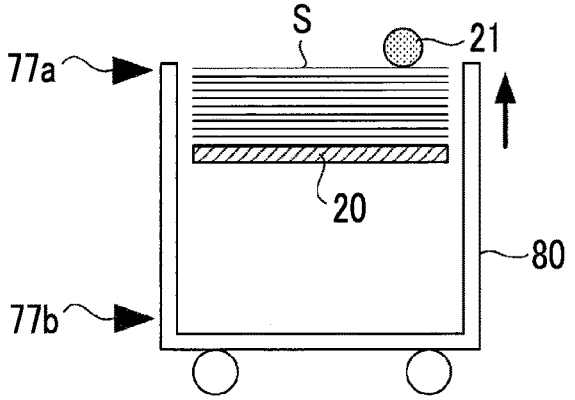
Figure 8:
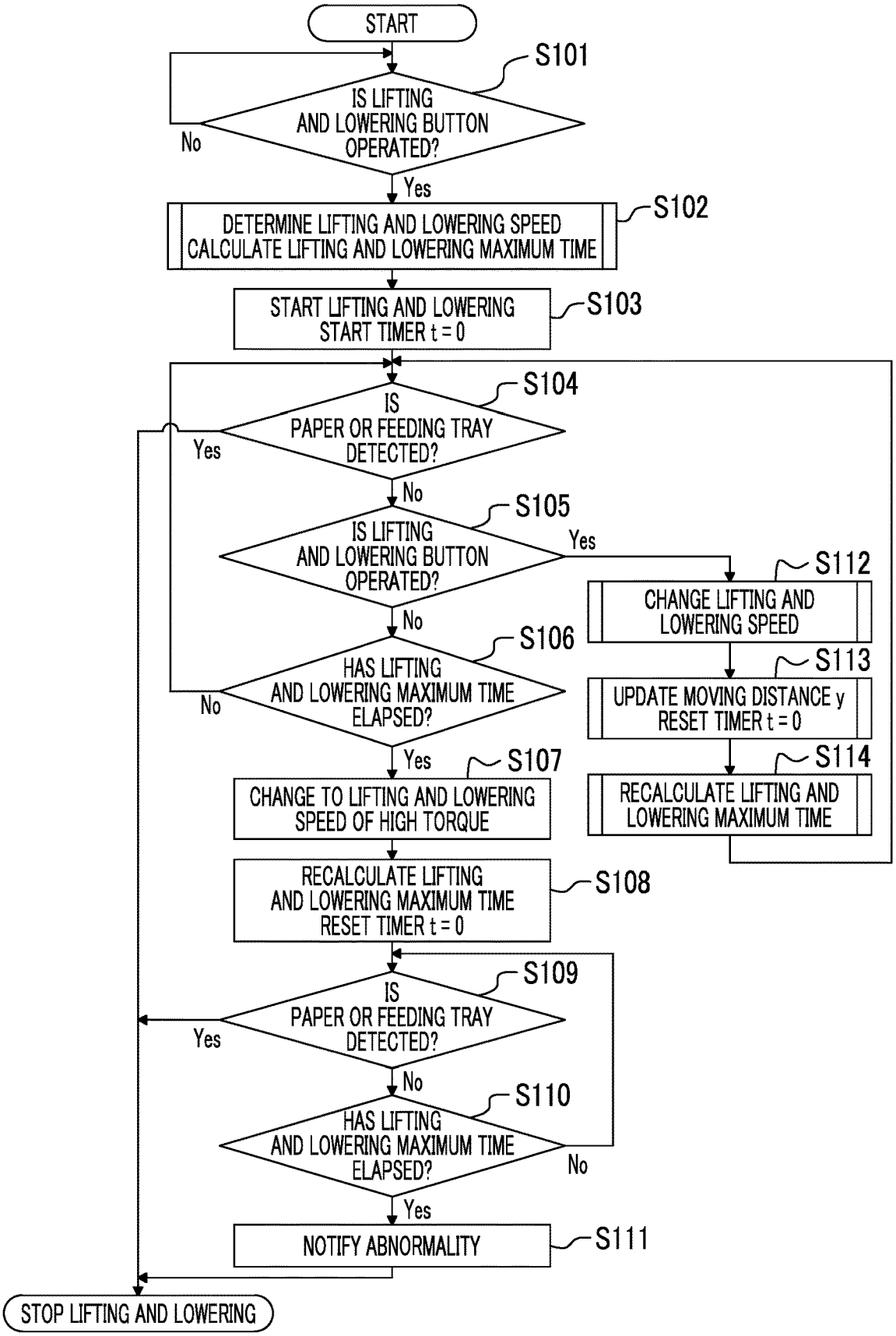
FIG. 8 is a flowchart showing the lifting and lowering operation of the feeding tray in the feeding device according to the exemplary embodiment of the present invention.

Then, in a case where the control unit 72 detects the paper S or the feeding tray 20 within the lifting and lowering maximum time calculated in Step S102 and before the lifting and lowering maximum time elapses with the detection unit 77*a* in Step S104, the control unit 72 performs control such that the feeding tray 20 is stopped at the feeding position, which is the upper end in the accommodation unit 80, as shown in FIG. 7D. The feeding tray 20 may be controlled so as to be stopped as the paper S placed on the uppermost portion of the feeding tray 20 is detected by the feeding roller 21.

In addition, in a case where the lifting and lowering button is not operated within the lifting and lowering maximum time calculated in Step S102 and the lifting and lowering maximum time elapses without the paper S or the feeding tray 20 being detected by the detection unit 77*a* in Steps S104 to S106, the control unit 72 assumes that it is a state where it is not detected that the paper or the feeding tray has reached the feeding position within the calculated lifting and lowering maximum time, performs control such that the lifting and lowering speed of the feeding tray 20 becomes slower than the determined lifting and lowering speed, and performs control such that the lifting and lowering speed is changed to, for example, an ultra-low speed, for example, 0.5 cm/sec by high torque with which a drive force larger than a drive force at a normal lifting and lowering speed is obtained, in Step S107. The control unit 72 may perform control such that the lifting and lowering speed of the feeding tray 20 becomes gradually slower than the determined lifting and lowering speed.

Then, in Step S108, the control unit 72 recalculates a lifting and lowering maximum time based on the changed lifting and lowering speed, and resets the timer.

Specifically, for example, in a case where the feeding tray 20 is lifted at a lifting and lowering speed of 1.0 cm/sec, which is a low speed, if the paper S or the feeding tray 20 is not detected even when 60 seconds, which is a lifting and lowering maximum time from the replenishing position to the feeding position, has elapsed, it is determined to be a state where the determined lifting and lowering speed cannot be realized since the weight of paper loaded on the feeding tray 20 is great and an excessive load is applied to the drive engine. Thus, control is performed such that the lifting and lowering speed is changed to a lifting and lowering speed of 0.5 cm/sec, which is an ultra-low speed slower than the low speed, and a lifting and lowering maximum time is recalculated. In this case, 120 seconds that is obtained by dividing 60 cm, which is the length from the current replenishing position to the feeding position, by the lifting and lowering speed of 0.5 cm/sec is recalculated as the lifting and lowering maximum time.

Then, in a case where the control unit 72 detects the paper S or the feeding tray 20 within the lifting and lowering maximum time recalculated in Step S108 and before the lifting and lowering maximum time elapses with the detection unit 77*a* in Step S109, the control unit 72 performs control such that the feeding tray 20 is stopped at the feeding position.

Then, the control unit 72 executes a print job.

In addition, in a case where the lifting and lowering maximum time has elapsed without the paper S or the feeding tray 20 being detected by the detection unit 77*a* within the calculated lifting and lowering maximum time in Steps S109 and S110, the control unit 72 determines that there is an abnormality in the drive engine, notifies the display operation unit 18, the terminal device, or the like of the abnormality in Step S111, and performs control such that the lifting and lowering of the feeding tray 20 is stopped.

Next, an operation of the feeding device 14 in a case where the lifting and lowering button is operated during the lifting and lowering of the feeding tray 20 in Step S105 will be described with reference to FIGS. 8 and 10 to 13C.

In a case where the lifting and lowering button is operated during the lifting and lowering of the feeding tray 20, the control unit 72 performs a lifting and lowering speed changing operation in Step S112. In this case, the control unit 72 acquires an operating time t before the lifting and lowering speed change until the lifting and lowering button is operated.

Figure 10:
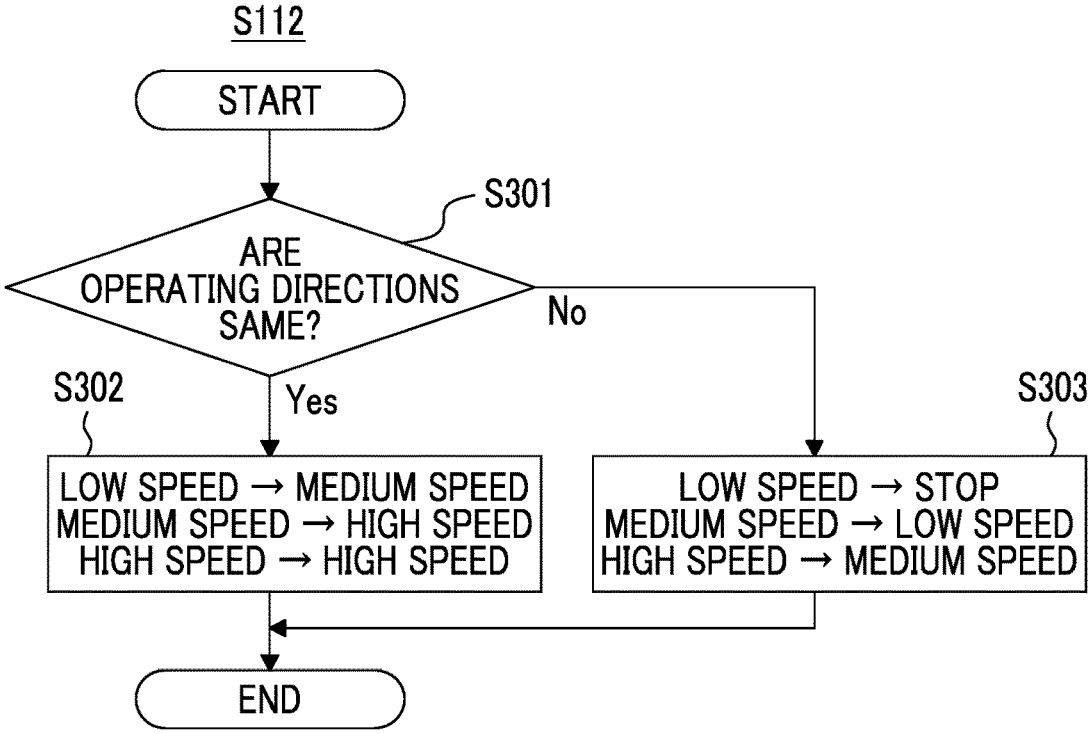
FIG. 10 is a flowchart for describing a lifting and lowering speed changing operation of the feeding device according to the exemplary embodiment of the present invention.

FIG. 10 is a flowchart for describing details of the lifting and lowering speed changing operation of Step S112.

First, in a case where the lifting and lowering button is operated during the lifting and lowering of the feeding tray 20, the control unit 72 determines whether an operation by the lifting and lowering button is pressing of the lifting button 82 or pressing of the lowering button 84, and determines whether or not a lifting and lowering direction of the feeding tray 20 and an operation direction by the lifting and lowering button are the same in Step S301.

Specifically, in a case where the lifting button 82 is pressed while the feeding tray 20 is being lifted or a case where the lowering button 84 is pressed while the feeding tray 20 is being lowered, it is determined that the lifting and lowering direction of the feeding tray 20 and the operation direction by the lifting and lowering button are the same and thus operating directions are the same. In addition, in a case where the lowering button 84 is pressed while the feeding tray 20 is being lifted or a case where the lifting button 82 is pressed while the feeding tray 20 is being lowered, it is determined that the lifting and lowering direction of the feeding tray 20 and the operation direction by the lifting and lowering button are different from each other and thus the operating directions are different from each other.

Then, in a case where it is determined that the operating directions are the same in Step S301, the control unit 72 performs control such that the lifting and lowering speed of the feeding tray 20 becomes one step faster than the current lifting and lowering speed in Step S302.

Specifically, control is performed such that the lifting and lowering speed of the feeding tray 20 is changed to a medium lifting and lowering speed in a case where the lifting button 82 is pressed while the feeding tray 20 is lifted at a low speed, the lifting and lowering speed of the feeding tray 20 is changed to a high lifting and lowering speed in a case where the lifting button 82 is pressed while the feeding tray is lifted at the medium speed, and the feeding tray is lifted and lowered without changing the lifting and lowering speed of the feeding tray 20 in a case where the lifting button 82 is pressed while the feeding tray is lifted at a high speed.

Similarly, control is performed such that the lifting and lowering speed of the feeding tray 20 is changed to a medium lifting and lowering speed in a case where the lowering button 84 is pressed while the feeding tray 20 is lowered at a low speed, the lifting and lowering speed of the feeding tray 20 is changed to a high lifting and lowering speed in a case where the lowering button 84 is pressed while the feeding tray is lowered at the medium speed, and the feeding tray is lifted and lowered without changing the lifting and lowering speed of the feeding tray 20 in a case where the lowering button 84 is pressed while the feeding tray is lowered at a high speed.

In addition, in a case where it is determined that the operating directions are different from each other in Step S301, the control unit 72 performs control such that the lifting and lowering speed of the feeding tray 20 becomes one step slower than the current lifting and lowering speed in Step S303.

Specifically, control is performed such that the feeding tray 20 is stopped in a case where the lowering button 84 is pressed while the feeding tray 20 is lifted at a low speed, the lifting and lowering speed of the feeding tray 20 is changed to a low lifting and lowering speed in a case where the lowering button 84 is pressed while the feeding tray is lifted at a medium speed, and the lifting and lowering speed of the feeding tray 20 is changed to the medium lifting and lowering speed in a case where the lowering button 84 is pressed while the feeding tray is lifted at a high speed.

Similarly, control is performed such that the feeding tray 20 is stopped in a case where the lifting button 82 is pressed while the feeding tray 20 is lowered at a low speed, the lifting and lowering speed of the feeding tray 20 is changed to a low lifting and lowering speed in a case where the lifting button 82 is pressed while the feeding tray is lowered at a medium speed, and the lifting and lowering speed of the feeding tray 20 is changed to the medium lifting and lowering speed in a case where the lifting button 82 is pressed while the feeding tray is lowered at a high speed.

Then, in Step S113, based on a lifting and lowering speed $v_n$ before the change and the operating time t depending on the lifting and lowering speed $v_n$, the control unit 72 updates a moving distance $y_n$ from the replenishing position, which is the current position of the feeding tray 20, and resets the timer, becoming t=0.

Figure 11:
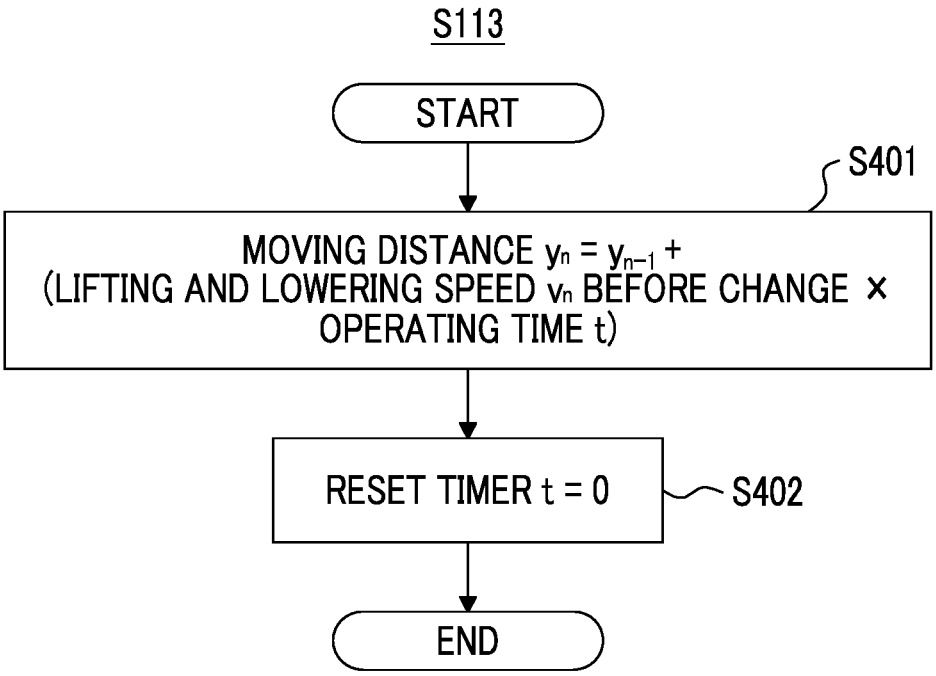
FIG. 11 is a flowchart for describing an updating operation of a moving distance of the feeding device according to the exemplary embodiment of the present invention.

FIG. 11 is a flow chart for describing details of an updating operation of the moving distance $y_n$ of the feeding tray 20 in Step S113.

In Step S401, the control unit 72 estimates the current position of the feeding tray 20 based on moving distance $y_n$=moving distance $y_{n-1}$+(lifting and lowering speed $v_n$ before change×operating time t), and updates the moving distance $y_n$. Herein, the moving distance $y_{n-1}$ indicates the position of the feeding tray 20 when movement starts at the lifting and lowering speed $v_n$.

Figure 13A:
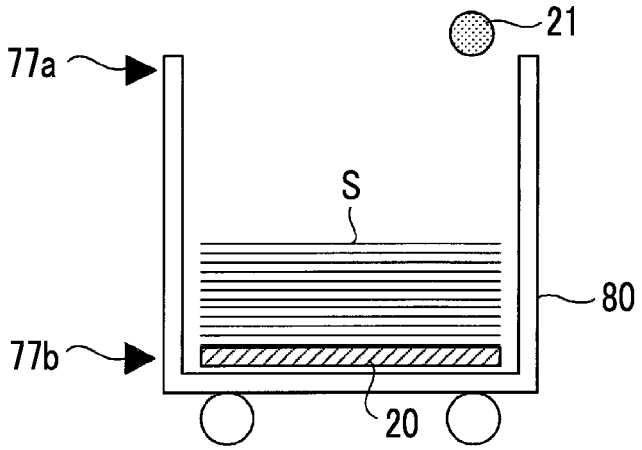
FIGS. 13A to 13C are views for describing the lifting and lowering operation of the feeding tray in the feeding device according to the exemplary embodiment of the present invention, and views for describing an operation in a case where the lifting and lowering speed is changed during lifting and lowering.
Figure 13B:
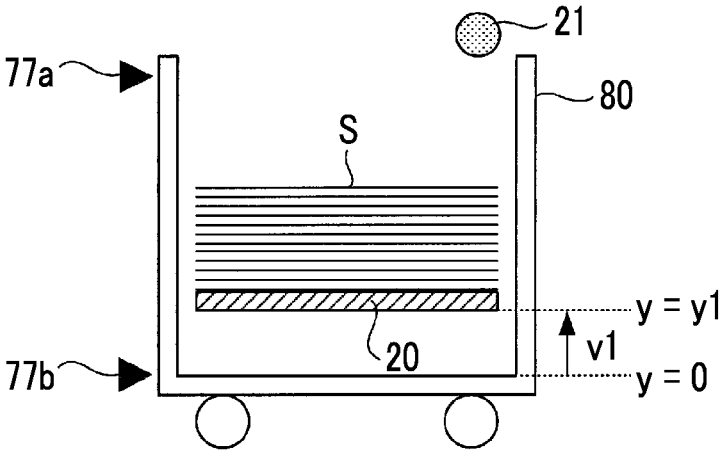
Figure 13C:
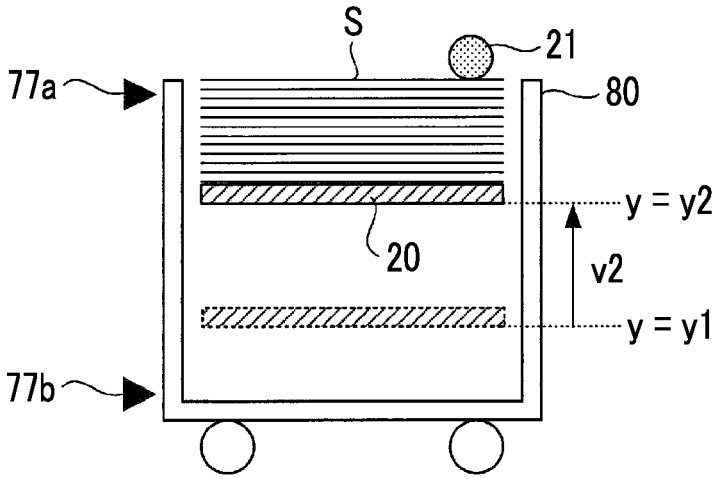

Specifically, for example, as shown in FIGS. 13A to 13C, in a case where the timer starts at a replenishing position y=0, which is the lower end of the accommodation unit 80, the lifting button 82 is pressed once after an operating time of 10 seconds from the start of lifting at 1.0 cm/sec, which is a lifting and lowering speed v1, and the lifting and lowering speed is changed to 2.0 cm/sec, which is a lifting and lowering speed v2, 10 cm, which is calculated by multiplying the lifting and lowering speed of 1.0 cm/sec by the operating time of 10 seconds, is updated as a moving distance y1 of the feeding tray 20 at a time point when the lifting button 82 is pressed.

Then, in Step S402, the control unit 72 resets the timer, becoming t=0.

Then, in Step S114, the control unit 72 recalculates a lifting and lowering maximum time based on a lifting and lowering speed $v_{n+1}$ after the change.

Figure 12:
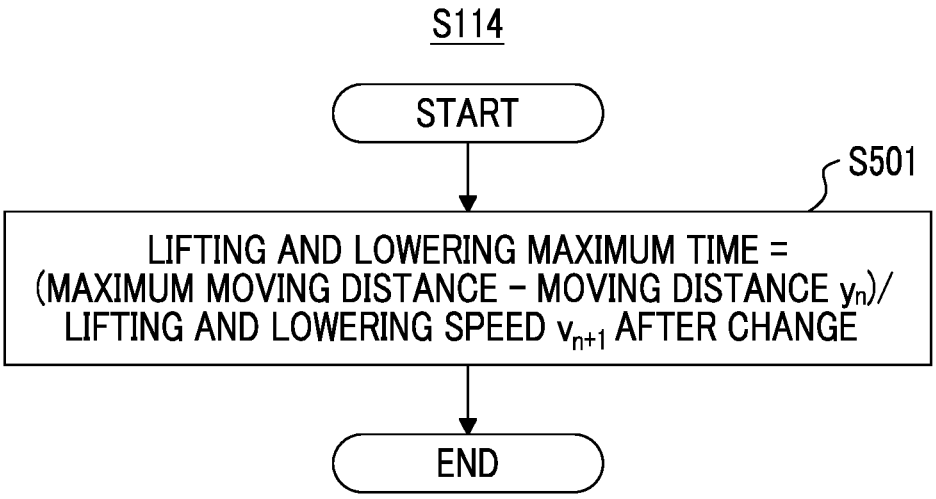
FIG. 12 is a flowchart for describing a recalculating operation of the lifting and lowering maximum time for the feeding device according to the exemplary embodiment of the present invention.

FIG. 12 is a flowchart for describing details of a recalculating operation of the lifting and lowering maximum time of Step S114.

That is, in a case where the moving distance $y_n$ is updated and the timer is reset, a moving distance by which the feeding tray is moved at the lifting and lowering speed $v_{n+1}$ after the change is calculated by calculating a difference between a maximum moving distance and the moving distance $y_n$ calculated in Step S401, and a lifting and lowering maximum time is recalculated by dividing the difference by the lifting and lowering speed $v_{n+1}$ after the change, in Step S501.

Specifically, as shown in FIGS. 13A to 13C, 25 seconds that is calculated by dividing 50 cm which is a difference between a maximum moving distance of 60 cm, which is the length from the replenishing position to the feeding position, and 10 cm, which is the updated moving distance y1, by 2.0 cm/sec, which is the lifting and lowering speed v2 after the change, is recalculated as a lifting and lowering maximum time.

Returning to the processing of Step S104, in a case where it is determined whether or not the detection unit 77*a* has detected the paper S or the feeding tray 20 within the recalculated lifting and lowering maximum time and before the recalculated lifting and lowering maximum time elapses and the lifting and lowering maximum time has elapsed without the paper S or the feeding tray 20 being detected by the detection unit 77*a*, the lifting and lowering speed of the feeding tray 20 is changed to, for example, an ultra-low speed, for example, 0.5 cm/sec, which is a lifting and lowering speed of high torque with which a drive force larger than a drive force at a normal lifting and lowering speed is obtained, in Step S107 described above.

Although a case where the control unit 72 lifts the feeding tray by the pressing of the lifting button 82 has been described in the exemplary embodiment described above, without being limited thereto, the same is applicable to a case where the control unit 72 lowers the feeding tray 20 by the pressing of the lowering button 84.

In the embodiments above, the term "processor" refers to hardware in a broad sense. Examples of the processor include general processors (e.g., CPU: Central Processing Unit) and dedicated processors (e.g., GPU: Graphics Processing Unit, ASIC: Application Specific Integrated Circuit, FPGA: Field Programmable Gate Array, and programmable logic device). In the embodiments above, the term "processor" is broad enough to encompass one processor or plural processors in collaboration which are located physically apart from each other but may work cooperatively. The order of operations of the processor is not limited to one described in the embodiments above, and may be changed.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A feeding device comprising:

an accommodation unit that accommodates paper;

a feeding tray on which the paper is placed in the accommodation unit and that is controlled so as to be lifted and lowered in a case of being replenished with the paper; and a processor configured to:

determine a lifting and lowering speed of the feeding tray according to an operation by a user, and perform control such that a lifting and lowering speed of the feeding tray becomes slower than the determined lifting and lowering speed in a case of a state where the determined lifting and lowering speed of the feeding tray is in a state that is unable to be realized.

2. The feeding device according to claim 1, further comprising:

a detector that detects a position of the feeding tray in the accommodation unit, wherein the processor is configured to:

calculate a lifting and lowering maximum time, which is a time until the feeding tray reaches a position set in advance, in a case of moving the feeding tray from a current position at the determined lifting and lowering speed, and perform control such that a lifting and lowering speed of the feeding tray becomes slower than the determined lifting and lowering speed in a case where the detector does not detect that the feeding tray has reached the position set in advance within the lifting and lowering maximum time.

3. The feeding device according to claim 2, wherein the processor is configured to:

recalculate the lifting and lowering maximum time in a case where the lifting and lowering speed of the feeding tray is changed during lifting and lowering of the feeding tray.

4. The feeding device according to claim 3, wherein the processor is configured to:

calculate, in a case where the lifting and lowering speed of the feeding tray is changed during the lifting and lowering of the feeding tray, a current position of the feeding tray from a lifting and lowering speed before the change and an operating time until the present and recalculate the lifting and lowering maximum time using a lifting and lowering speed after the change.

5. The feeding device according to claim 2, wherein the processor is configured to:

perform control such that the lifting and lowering speed of the feeding tray becomes gradually slower in a case where the detector does not detect the position of the feeding tray within the lifting and lowering maximum time.

6. The feeding device according to claim 3, wherein the processor is configured to:

perform control such that the lifting and lowering speed of the feeding tray becomes gradually slower in a case where the detector does not detect the position of the feeding tray within the lifting and lowering maximum time.

7. The feeding device according to claim 4, wherein the processor is configured to:

perform control such that the lifting and lowering speed of the feeding tray becomes gradually slower in a case where the detector does not detect the position of the feeding tray within the lifting and lowering maximum time.

8. The feeding device according to claim 2, wherein the processor is configured to:

perform control such that the lifting and lowering speed of the feeding tray is changed to a lifting and lowering speed at which a drive force larger than a drive force at a normal lifting and lowering speed is obtained, in a case where the detector does not detect the position of the feeding tray within the lifting and lowering maximum time.

9. The feeding device according to claim 3, wherein the processor is configured to:

perform control such that the lifting and lowering speed of the feeding tray is changed to a lifting and lowering speed at which a drive force larger than a drive force at a normal lifting and lowering speed is obtained, in a case where the detector does not detect the position of the feeding tray within the lifting and lowering maximum time.

10. The feeding device according to claim 4, wherein the processor is configured to:

perform control such that the lifting and lowering speed of the feeding tray is changed to a lifting and lowering speed at which a drive force larger than a drive force at a normal lifting and lowering speed is obtained, in a case where the detector does not detect the position of the feeding tray within the lifting and lowering maximum time.

11. The feeding device according to claim 8, wherein the processor is configured to:

recalculate the lifting and lowering maximum time using the lifting and lowering speed after the change at which the drive force larger than the drive force at the normal lifting and lowering speed is obtained, and perform control such that a notification of an abnormality of a driving mechanism of the feeding tray is issued in a case where the detector does not detect the position of the feeding tray within the recalculated lifting and lowering maximum time.

12. The feeding device according to claim 9, wherein the processor is configured to:

recalculate the lifting and lowering maximum time using the lifting and lowering speed after the change at which the drive force larger than the drive force at the normal lifting and lowering speed is obtained, and perform control such that a notification of an abnormality of a driving mechanism of the feeding tray is issued in a case where the detector does not detect the position of the feeding tray within the recalculated lifting and lowering maximum time.

13. The feeding device according to claim 10, wherein the processor is configured to:

recalculate the lifting and lowering maximum time using the lifting and lowering speed after the change at which the drive force larger than the drive force at the normal lifting and lowering speed is obtained, and perform control such that a notification of an abnormality of a driving mechanism of the feeding tray is issued in a case where the detector does not detect the position of the feeding tray within the recalculated lifting and lowering maximum time.

14. An image forming apparatus comprising:

an accommodation unit that accommodates paper;

a feeding tray on which the paper is placed in the accommodation unit and that is controlled so as to be lifted and lowered in a case of being replenished with the paper;

a feeding roller that feeds the paper placed on an uppermost portion of the feeding tray one by one;

an image output unit that outputs an image to the fed paper; and a processor configured to:

determine a lifting and lowering speed of the feeding tray according to an operation by a user, and perform control such that a lifting and lowering speed of the feeding tray becomes slower than the determined lifting and lowering speed in a case of a state where the determined lifting and lowering speed of the feeding tray is unable to be realized.

15. A feeding method comprising:

determining a lifting and lowering speed of a feeding tray according to an operation by a user; and performing control such that a lifting and lowering speed of the feeding tray becomes slower than the determined lifting and lowering speed in a case of a state where the determined lifting and lowering speed of the feeding tray is in a state that is unable to be realized.

* * * * *